United States Patent [19]

Adamec et al.

[11] 4,368,774

[45] Jan. 18, 1983

[54] MOULD FOR THE HORIZONTAL CONTINUOUS CASTING OF METALS

[76] Inventors: Alfred Adamec, Tschudigasse 16, 1220 Vienna; Roland Leder, Alseggerstrasse 19, 1180 Vienna, both of Austria

[21] Appl. No.: 171,530

[22] Filed: Jul. 23, 1980

[30] Foreign Application Priority Data

Sep. 24, 1979 [AT] Austria ..... 6249/79

[51] Int. Cl.[3] ..... B22D 11/00

[52] U.S. Cl. ..... 164/418; 164/435; 164/440

[58] Field of Search ..... 164/418, 436, 440, 459, 164/490, 491, 435

[56] References Cited

U.S. PATENT DOCUMENTS

| | | | |
|---|---|---|---|
| 3,580,327 | 5/1971 | Khimich | 164/435 |
| 3,731,728 | 5/1973 | Webbere et al. | 164/440 |

FOREIGN PATENT DOCUMENTS

| | | | |
|---|---|---|---|
| 750887 | 6/1944 | Fed. Rep. of Germany . | |
| 252478 | 3/1965 | Fed. Rep. of Germany . | |
| 1508822 | 11/1969 | Fed. Rep. of Germany | 164/436 |
| 285845 | 3/1970 | Fed. Rep. of Germany . | |
| 1583568 | 9/1970 | Fed. Rep. of Germany . | |
| 2025764 | 2/1971 | Fed. Rep. of Germany . | |
| 1758982 | 2/1973 | Fed. Rep. of Germany . | |
| 47-32178 | 8/1972 | Japan | 164/418 |
| 52-54622 | 5/1977 | Japan | 164/418 |
| 570216 | 12/1975 | Switzerland | 164/440 |
| 761401 | 11/1956 | United Kingdom . | |

OTHER PUBLICATIONS

"Handbook on Continuous Casting", by Dr. Erhard Herrmann, Aluminium-Verlag GmbH, Dusseldorf, pp. 129–137.

*Primary Examiner*—Gus T. Hampilos
*Assistant Examiner*—K. Y. Lin
*Attorney, Agent, or Firm*—Blanchard, Flynn, Thiel, Boutell & Tanis

[57] ABSTRACT

Mould for the horizontal continuous casting of metals comprising a first mould part which is adapted to have an intensive cooling effect on the metal being cast and which has a reduced inflow cross-section for the metal relative to casting cavity; a support frame; and a second mould part which is formed by several elements carried by the support frame, the elements being movable radially relative to the support frame.

13 Claims, 8 Drawing Figures

MOULD FOR THE HORIZONTAL CONTINUOUS CASTING OF METALS

FIELD OF THE INVENTION

The invention relates to a mould for the horizontal continuous casting of metals, particularly of steel.

BACKGROUND OF THE INVENTION

Known moulds for the horizontal continuous casting of non-ferrous metals consist of a mould body, preferably manufactured from electro-graphite, in which a casting cavity is formed and which is enclosed by a casing made of metal, preferably copper. In this arrangement, the casing is designed with a cooling system. Electro-graphite is suitable for the manufacture of the mould body, particularly on account of its good sliding and self-lubricating properties, low wettability and good thermal conductivity.

For the horizontal continuous casting of ferrous metals, particularly of steel, a design, similar to that disclosed, for example, in U.S. Pat. No. 3,731,728, must be chosen, due to a possible reaction of the liquid metal with graphite. To protect the mould, a so-called inflow orifice, made of high quality material, is located on its inflow side, the open cross-section of this orifice being smaller, as appropriate, than the cross-section of the casting cavity. After the inflow orifice, in the direction of withdrawal of the continuous casting, a first mould part is provided, which effects the intensive cooling of the continuous casting. The length of the first mould part amounts to only a part of the length of the complete mould. The first mould part preferably consists of a copper mould tube, the cross-section of which corresponds to the cross-section of the continuous casting. There then follows a graphite mould of the type known for the casting of non-ferrous metals.

Subsequent to the initial formation of a solidified shell of continuous casting, this design takes advantage of the good sliding and self-lubricating properties of the graphite, the intrinsically very complicated introduction of releasing agents and/or lubricants thus being avoided.

As is evident from the periodical "Aluminium", Volume 5, 1975, from German Offenlegungsschrift No. 2,737,835 and from German Offenlegungsschrift No. 2,854,144, the siting of inflow orifices at the inlet position of moulds has also been disclosed with reference to the casting of non-ferrous metals.

The important difference, relative to the embodiments of moulds described above, resides in the fact that, in the case of moulds for casting steel, a short intensive cooling section is provided between the inflow orifice and the graphite mould, this section being made of a material with a high thermal conductivity. However, both these types of embodiment are disadvantageous, in that, following formation of the solidified shell of the continuous casting, the latter starts to pull away from the cooled mould wall, thus forming a shrinkage gap which restricts the heat transfer to such an extent that, due to the impairment of the mould cooling performance, the production performance of the mould is markedly reduced.

In order to bring about improved contact between the continuous casting and the inner wall of the mould and thus an improvement in the mould cooling performance, it has been proposed to shape the casting cavity of the mould with a conical taper in the direction of withdrawal of the continuous casting (concurrent cone). For example, the mould according to U.S. Pat. No. 3,731,728 is also designed to taper conically in this way.

In horizontal continuous casting, the continuous casting is predominantly withdrawn in a stepwise manner according either to the so-called go-stop procedure or, alternatively, according to the so-called pilger stepwise procedure, in which short reverse movements of the continuous casting occur after the withdrawal movement, or by a combination of these two procedures. At the metal inflow end, a mould part without tapering of the casting cavity is required, or, in the case of small cross-sections, a mould part is required which even has a casting cavity widening conically over several increments (reverse cone), in order to spare the relatively thin solidified shell of the continuous casting from subjection to excessive frictional forces. The beginning of the shrinkage gap, which causes a restriction in the cooling of the continuous casting, is also situated within the intensive cooling part, where the solidification of the metal commences. Due to the stepwise or also partly reverse movements, even a subsequent conical tapering of the casting cavity of the mould (concurrent cone) can produce no effective improvement in the cooling performance.

The object of the invention is accordingly to avoid the above-mentioned disadvantages, namely to ensure a good contact between the continuous casting and the wall of the casting cavity of the mould, for any mode of operation. That is to say, for example, it is desirable to produce this good contact also when reverse movements of the continuous casting occur.

SUMMARY OF THE INVENTION

According to the present invention, there is provided a mould for the horizontal continuous casting of metals, comprising a first mould part which is adapted to have an intensive cooling effect on the metal being cast and which has a reduced inflow cross-section for the said metal relative to the casting cavity; a support frame; and a second mould part which is formed by several elements carried by the support frame, the elements being movable radially relative to the support frame.

BRIEF DESCRIPTION OF THE DRAWINGS

The invention is illustrated, merely by way of example, in the accompanying drawings, in which.

DESCRIPTION OF THE PREFERRED EMBODIMENT

Figure 1:
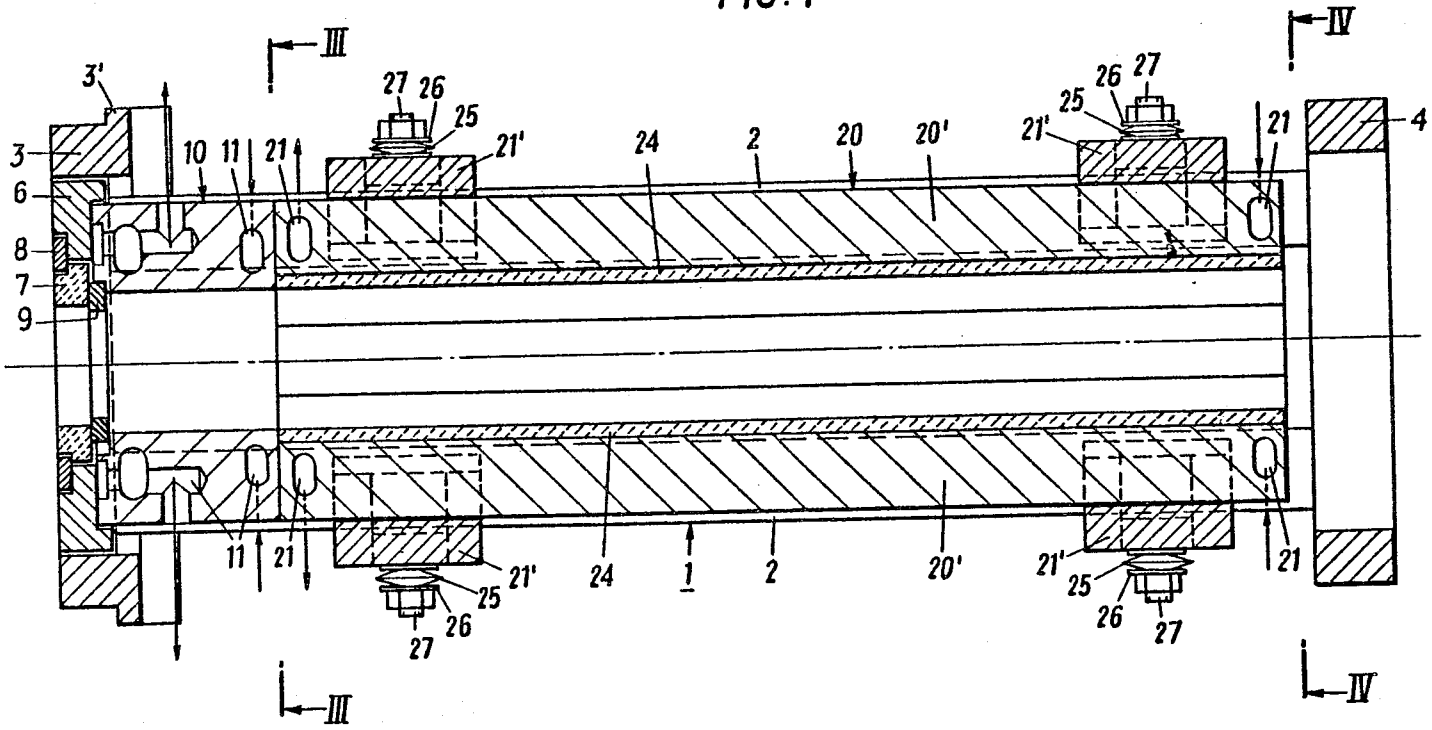
FIG. 1 is a vertical longitudinal section through a continuous casting mould according to the present invention.
Figure 1A:
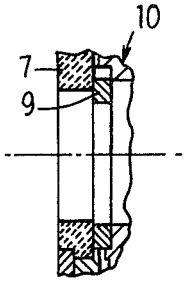
FIG. 1A is a fragment of FIG. 1 taken at the inlet end thereof and showing the inflow orifice displaced downward in relation to the axis of the mold.

Referring to the drawings, a mould according to the invention comprises a support frame 1, which retains a first mould part 10 and a second mould part 20, which are described in greater detail below. An inflow orifice 9 is located at the inlet end of the first mould part 10.

Figure 2:
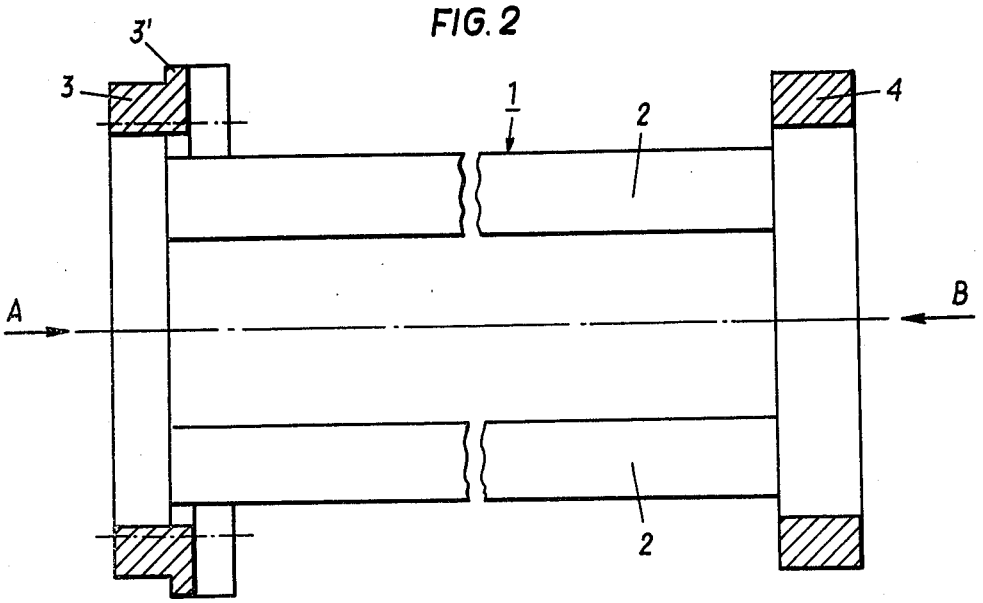
FIG. 2 is a vertical median section of a support frame for this mould, partly interrupted.
Figure 2A:
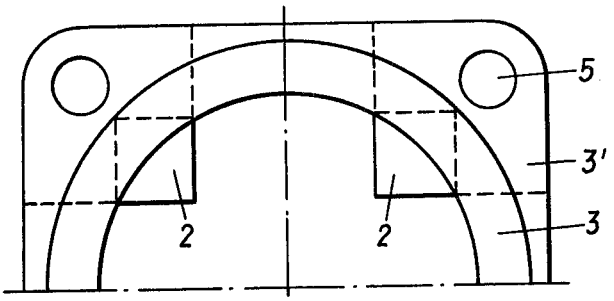
FIGS. 2*a* and 2*b* are views of the support frame in the direction of the arrows A and B in FIG. 2.
Figure 2B:
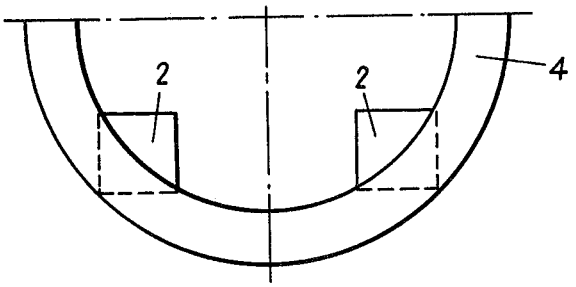

As can be seen particularly from FIGS. 2, 2*a* and 2*b* the support frame 1 consists of horizontal support rails 2, which are joined together by means of end-frames 3 or end-rings 4, located at the ends of the rails. The end-frame 3, shown on the left-hand side of FIG. 2, is formed with a flange 3', provided with attachment holes 5 (FIG. 2*a*) by means of which the end-frame 3 can be attached to a holding vessel (not shown) for the metal. The end-ring 4, located at the inflow orifice of the mould, holds a first pressure-ring 6 (FIG. 1) in position, the inner face of the first pressure ring 6 bearing on the first mould part 10. The first mould part 10, which is pushed into the support frame 1 along the rails 2, is thus retained in its axial position between an end-stop (not shown) on the support frame 1 and the first pressure-ring 6. An additional ring 7, made of ceramic material, is placed in the central aperture of the first pressure-ring 6. The ceramic ring 7 is retained in position by means of a second pressure-ring 8. The latter is seated in a ring-shaped groove located partly in the pressure-ring 6 and partly in the ceramic ring 7. The inflow orifice 9 is located between the ceramic ring 7 and the first mould part 10, this orifice being in the form of a ring the aperture of which is smaller than the open cross-section of the adjoining casting cavity of the first mould part 10.

The first mould part 10 is made of material which conducts heat well, for example of copper. To conduct the heat away, this mould part incorporates a system of channels 11 through which coolant, for example, water, can be passed in.

The second mould part 20 adjoins, in the direction of withdrawal of the continuous casting, the first mould part 10. The second mould part 20 consists of several elements 20', their surfaces facing the casting cavity being overlaid with graphite 24, preferably with electro-graphite. The casting cavity of the second mould part 20 is preferably designed with a slight conical taper in the direction of withdrawal of the continuous casting. To cool the second mould part 20, its elements 20' similarly incorporate a system of channels 21.

The first mould part 10 is formed in one piece. In contrast thereto, the second mould part 20 is, as mentioned, formed by several elements 20' which extend in the longitudinal direction of the mould and which can be moved radially apart, in the sense of enlarging the cross-section of the mould cavity, against the action of springs 25, the latter bearing on the external surfaces of these elements.

Figure 3:
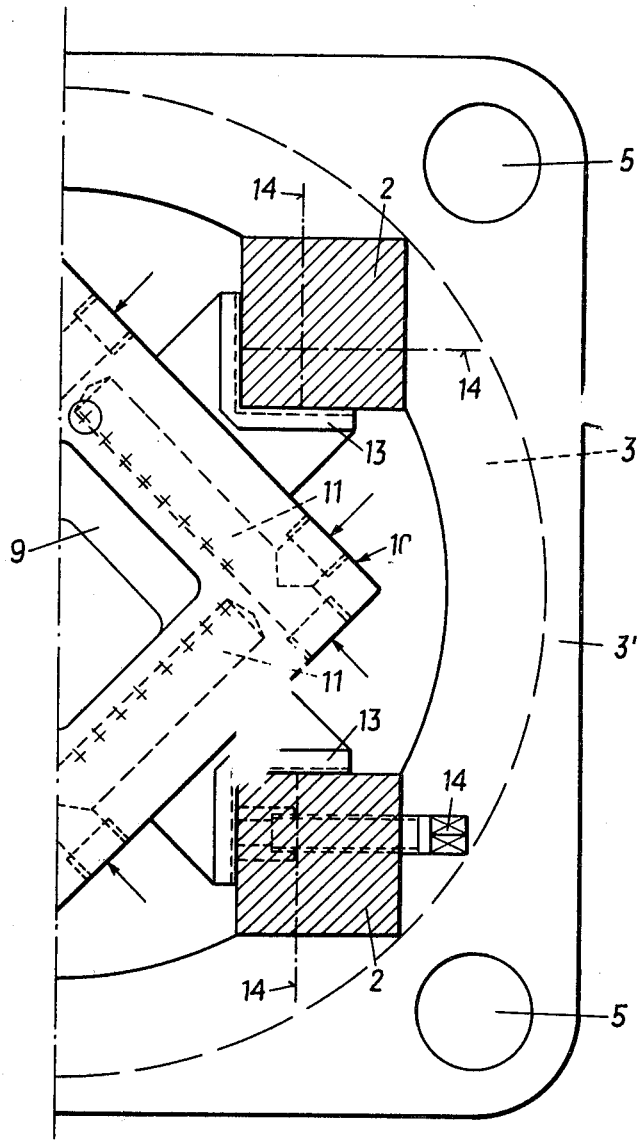
FIG. 3 is a cross-section through the mould, along the line III—III in FIG. 1, on an enlarged scale and showing the inflow orifice displaced downward as in FIG. 1A.

As can be seen from FIG. 3, the first mould part 10 is provided with guide-blocks 13, which come into contact with the support rails 2. Screws 14 are set in the support rails 2, by means of which the first mould part 10 can be brought into the correct position in relation to the axis of the mould. Of these screws 14, only one is shown in detail, the others being indicated by chain-dotted lines. This figure further shows that the orifice ring 9 can be displaced so far downwards that its lower boundary surfaces become flush with the lower wall surfaces of the casting cavity of the first mould part 10. The object of this particular arrangement of the orifice body 9 is further explained below.

Figure 4:
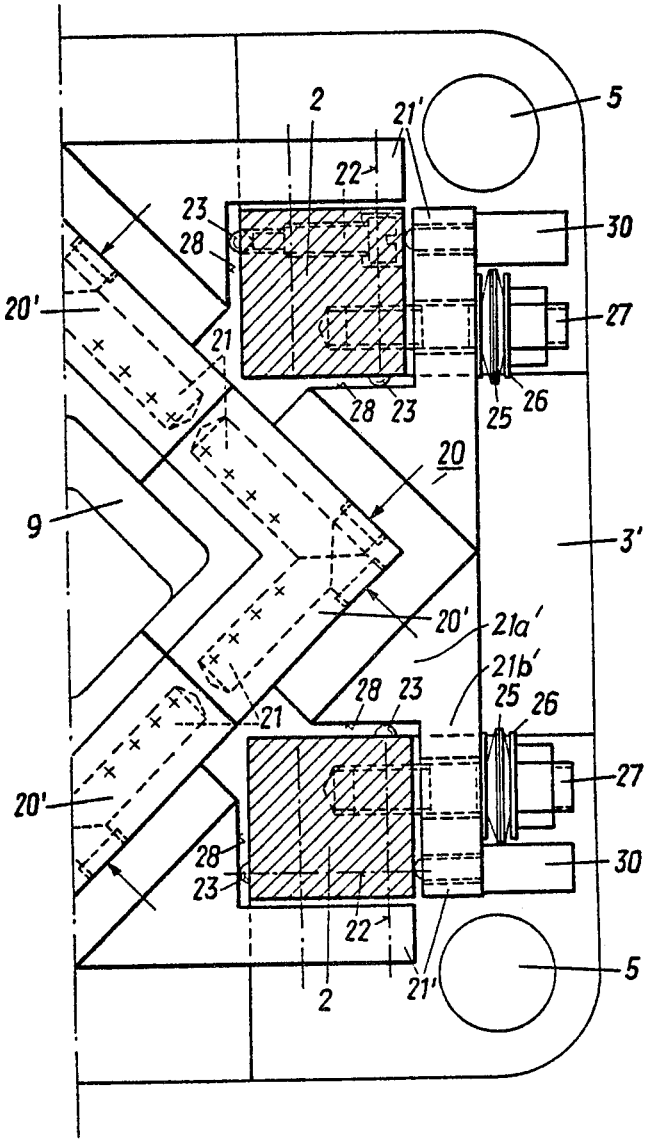
FIG. 4 is a cross-section through the mould, along the line IV—IV in FIG. 1, on an enlarged scale and showing the inflow orifice displaced downward as in FIG. 1A.
Figure 5:
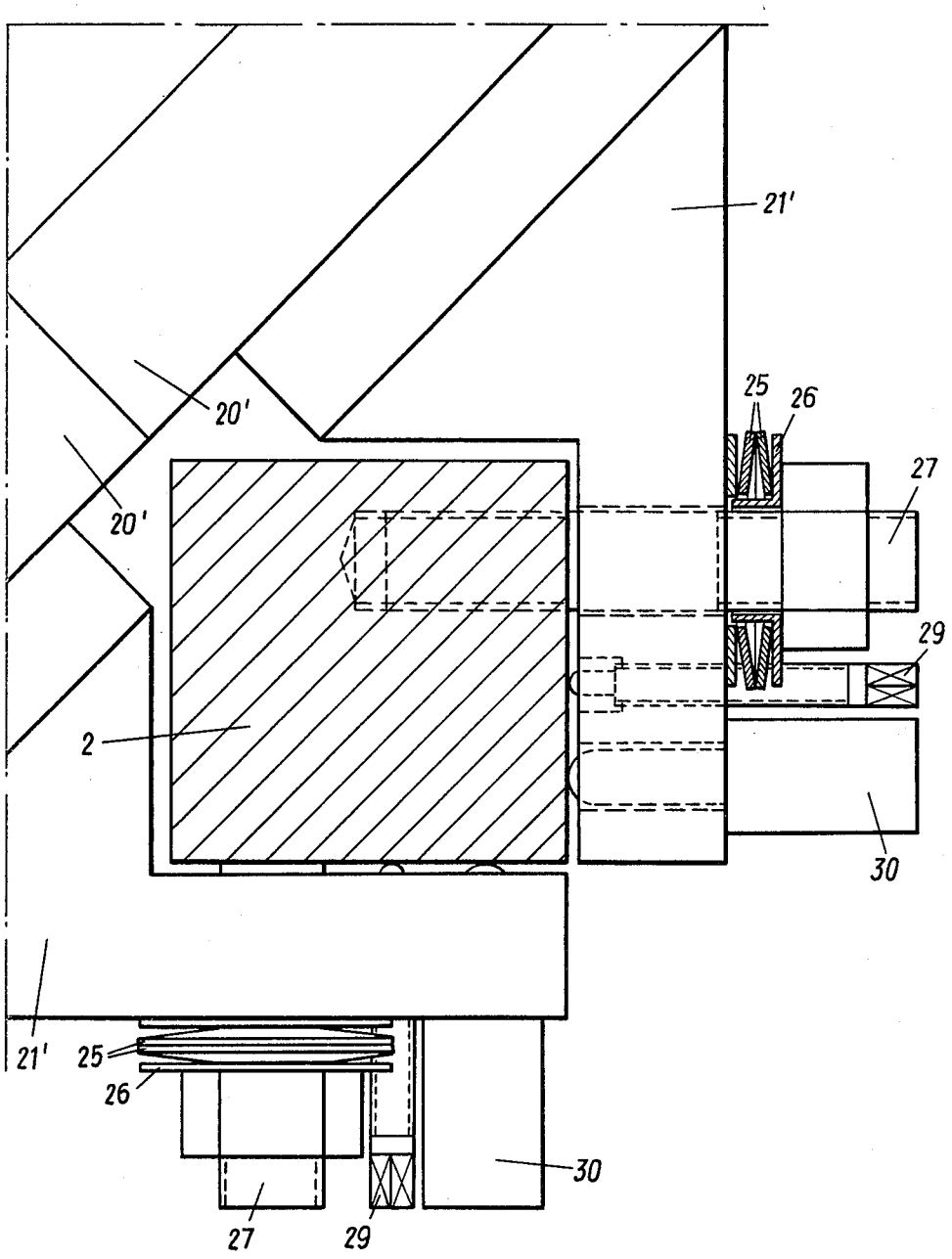
FIG. 5 shows a detail on a further enlarged scale of the FIG. 4 device.

The second mould part 20 is assembled from four elements 20', of which three elements 20' are shown in FIG. 4. These elements 20' are provided, preferably in the region of both their ends, with radially outward extending retaining stubs 21', each having a radially inner portion 21*a'* extending between a circumferentially flanking pair of said rails and a radially outer overlapping portion 21*b'* which lies radially outward of said flanking pair of rails 2 and extends circumferentially to overlap same. Each overlapping portion 21*b'* defines with the adjacent side of the radially inner sides of the adjacent rail 2, such that each rail 2 lies in and is at least in part bounded by opposed surfaces of the opposed recess of two adjacent retaining stubs 21'. The stubs 21' serve to guide and hold these elements 20', while allowing movement thereof. To adjust these elements 20', the support rails 2 are traversed by adjusting screws 22, at the ends of which are provided bearing balls 23 which bear on guide surfaces 28 of the stubs 21' provided by the recesses therein. The adjusting screws 22 enable the elements 20' to be centered, that is to say, to be aligned between the rails 2. Furthermore, as shown in FIG. 5, setting screws 29 are provided, located at right angles to the adjusting screws 22, the setting screws 29 enabling the elements 20' to be adjusted in the radial direction. In addition, Belleville springs 25 bear against surfaces normal to the guide surfaces 28 of the retaining stubs 21', these springs being carried by bolts 27, screwed into the support rails 2.

Because the elements 20' of the second mould part 20 are held in this way, they can be moved radially, in the sense of enlarging the cross-section of the casting cavity of the mould. During the withdrawal of the continuous casting, this movement can be effected by the continuous casting itself, or it can be effected by means of additional translating devices.

The individual holding and positioning components are shown, enlarged, in FIG. 5. This figure shows that the springs 25 are also provided with guide sleeves 26 by means of which the opening travel of the elements 20' can be set.

The mode of operation of the mould according to the invention is explained below and further particulars are given regarding the materials used for the individual parts:

Since, on the one hand, the friction occurring during withdrawal of the continuous casting, between its surface and the internal surface of the mould, should be kept as low as possible, particularly to avoid damage to the solidified shell and to increase the service life of the mould, and since, on the other hand, the shrinkage gap should also be kept as small as possible in order to achieve a powerful cooling effect in the mould, the second mould part 20 is formed from several elements 20', which are radially displaceable in the sense of enlarging the casting cavity. In this way, these elements 20' can collectively contact the continuous casting in an optimum manner. The pre-requisite for the proper functioning of this second mould part 20 is that the continuous casting should already have developed a solidified shell on entry to the second mould part 20. This solidified shell develops in the first mould part 10, which is located in advance of the second mould part 20 and which has an intensive cooling effect.

For this reason, the first mould part 10 must be made of a material with a high thermal conductivity. Development of the solidified shell on the continuous casting in the first mould part 10 is also promoted by likewise manufacturing the ring-shaped inflow orifice 9 from a material which can conduct heat well. In contrast, to insulate the inflow orifice 9 from the holding furance the ceramic ring 7 is made of a highly insulating material, thereby reducing cooling in the reverse direction.

The ceramic ring 7, which is pressed against the inflow orifice 9 by means of the second pressure-ring 8, is preferably made of zirconium oxide. In order to guarantee the necessary leak-tightness towards metal between the inflow orifice 9 and the ceramic ring 7, even when no mortar is used, the surfaces of both these rings are of high quality.

The inflow orifice 9 is made of a high quality material possessing good thermal conductivity and a low wettability. Depending on the type of casting, graphite, boron nitride or silicon nitride may, for example, be used for this purpose. The shape of the cross-section of the inflow orifice 9 is selected to correspond with the cross-sectional shape of the cast product. In the case of rectangular or square shapes, the inflow aperture must have a corner-radius of at least 10 mm. The inflow orifice 9 is positively attached to the mould part 10, by press-fitting, for example. The inflow orifice can accordingly have a conical outer surface.

Furthermore, the inflow aperture must allow the metal to flow at a minimum of 0.2 m/sec in the case of non-ferrous metals and at a minimum of 0.5 m/sec in the case of ferrous metals. The aperture of the inflow orifice 9 is calculated by means of the formula $q=(v\times Q)/(V)$, where v is the withdrawal velocity, Q the product cross-section and V is the inflow velocity.

As already mentioned, the first mould part 10, which has an intensive cooling effect, is made of a material with a high thermal conductivity, such as, for example, copper. Depending on the material to be cast, the casting cavity of the first mould part 10 can be overlaid with boron nitride, silicon nitride or graphite. These materials, which conduct heat well and possess optimum sliding properties and low wettability, can be press-fitted, or the copper casing can be shrunk onto the mould components manufactured from these materials. Finally, the surface of the casting cavity can also be coated as well as overlaid, e.g. by chromium-plating. Preferred materials which may be used for manufacturing the first mould part 10 are the Cu-Ag, Cu-Cr and Cu-CrZr alloys. Depending on the material and product cross-section to be cast, the first mould part 10 can be from 5 to 20 cm in length. In contrast, the second mould part can have a length of, for example, 70 to 100 cm in the case of ferrous metals and a length of at least 20 cm in the case of non-ferrous metals.

As already mentioned above, the second mould part 20 consists of several copper elements, each incorporating a cooling system, which can be radially moved in order to enlarge the cross-section of the casting cavity. These elements are preferably overlaid with graphite on their surface which encloses the casting cavity. Because the mobility of the elements markedly reduces the friction, their inner surface can also consist of copper, thereby ensuring a particularly good cooling performance.

Furthermore, the elements can be designed to include a concurrent conical taper, corresponding to the shrinkage of the cast material. However, due to the ability to move the elements, such a taper can also be dispensed with. In the case of circular or rectangular product cross-sections, four individual elements are preferably employed. The elements are designed as flat segments, angle segments or arcuate segments, depending on the product section to be cast.

FIG. 4 of the drawings show elements 20' designed as angle segments for a square-section product. It is advantageous to use angle segments in the case of square-section products with rounded edges, whereas, in the case of sharp-edged product sections, flat segments may also be used.

At least two springs 25 are allocated to each element 20', the preload of these springs being chosen such that the contact pressure of the elements 20' on the continuous casting amounts to approximately 80% of the metallostatic pressure. The pressure force of the springs 25 is set with the aid of a torque spanner, according to the characteristic curve of the Belleville springs used. The desired opening travel is set by means of the spring guide sleeve. The mode of operation of this part of the mould, assembled from movable elements, is as follows:

As soon as the radial forces, generated during the withdrawal process by friction between the continuous casting and the mould elements, exceed the preset spring force, the elements 20' of the mould part 20 are moved radially apart. These repositioning movements are of the order of magnitude of 0.01 to 0.1 mm.

During the subsequent cooling phase, that is to say during the standstill period or slow reverse-movement period following the withdrawal period, the elements are pushed back again by means of the springs 25. Optimum conformal contact of the elements 20' of the second mould part 20 against the continuous casting is thus brought about, thereby ensuring cooling of the continous casting which could not be achieved hitherto.

This operation presupposes that the continuous casting has an absolutely stable solidified shell, in terms of its shape, on leaving the relatively short first mould part 10. Since such stability of shape is not always assured with certain types of steel, it can also be expedient to bring about the parting movement of the elements 20' of the second mould part 20, and the release of the continuous casting, by means of translating devices provided specifically for this purpose, these devices being controlled in accordance with the process of withdrawing the continuous casting. By this means, a completely friction-free withdrawal process can be achieved in the second mould part 20. This movement of the elements 20' can be performed by mechanical, electrical, pneumatic or hydraulic means. The ideal condition, with regard to the operation of withdrawing the continuous casting, is attained when the elements lie beside the continuous casting during the withdrawal process, without friction.

The movement of the elements 20' can be controlled by means of a programmed electronic controller, for example by a microprocessor. The displacement of the elements can, for example, be effected by means of an electro-hydraulic linear amplifier 30. This is a positioning device, for linear movements involving friction, in which the demand value is preferably inputted to an electric stepping-motor, the rotary movement being converted into a linear movement to a positioned accuracy of 1/1000 mm. Additionally, hydraulic cylinders can also be used for displacing the elements.

As can be seen from FIG. 4 of the drawing, the inflow orifice 9 is, in this representation, displaced downwards in such a manner than its lower interior surfaces are flush with the lower surfaces of the casting cavity of the mould part 10.

In this regard, the following should be noted: The specialist in this art is aware that, during horizontal continuous casting using a conventional mould, the solification centre of the continuous casting is always displaced upwards relative to the geometric axis. Consequently, a delay in solidified shell formation occurs in the upper cross-sectional zone. This lack of uniformity in the temperature distribution over the cross-section of the continuous casting is due to the thermal convection in the liquid metal of the casting.

In order to avoid this lack of thermal uniformity in the continuous casting, the inflow orifice 9, provided at the inlet of the first mould part 10, is displaced downwards in relation to the axis of the mould, whereby a stronger flow occurs in the lower zone of the casting and the above-mentioned effects are avoided to the greatest possible extent. In this way, a temperature equalisation can be brought about in the molten core of the continuous casting.

The effect of this precaution can be enhanced by manufacturing the inflow orifice from a material with a high thermal conductivity. By this means, the upper wall of the orifice, in parallel with the intensively cooling mould, gives rise to an additional crystallisation. In order to ensure the necessary thermal insulation of the inflow orifice from the adjacent holding vessel for the metal, the orifice is, as stated, separated from this vessel by an insulating ring.

We claim:

1. Mould for the horizontal production of a continuous casting of metals comprising a first mould part which is adapted to have an intensive cooling effect on the metal being cast and which has a reduced inflow cross-section for the said metal relative to the casting cavity; a support frame; a second mould part connected downstream of said first mould part and which is formed by several elements carried by the support frame, the elements being movable radially relative to the support frame; moving means cooperative with said support frame and second mould part elements and actuable for moving said second mould part elements apart radially far enough that during the withdrawing movement of the continuous casting that the part of the continuous casting entering and located in the second mould part is freed during its withdrawing movement from the elements of the second mould part; springs which act on the elements of the second mould part, the elements being radially displaceable against the action of the springs and being displaceable towards each other by means of these springs, in which said frame comprises frame rails alternating circumferentially with said elements and the springs act between each element of the second mould part and the circumferentially flanking pair of rails.

2. Mould for the horizontal production of a continuous metal casting, comprising:

a first mould part which is adapted to have an intensive cooling effect on the metal being cast and which has a reduced inflow cross section for metal relative to the casting cavity;

a second mould part connected to the downstream end of the first mould part and formed by several elements;

a support frame having horizontal support rails alternating circumferentially with said elements and means joining together the support rails at the opposite ends thereof, said first and second mould parts being aligned along a common axis about which said support rails are clustered, such that said first and second mould parts define a cavity which is substantially within the confines of said cluster of rails;

means fixing said first mould part to said rails adjacent one end thereof;

said second mould part elements each including a portion engageable with and between the flanking portions of the other elements for forming the mould cavity of the second mould part, said elements being provided with radially outward extending retaining stubs each having a radially inner portion extending between a circumferentially flanking pair of said rails and a radially outer overlapping portion which lies radially outward of said flanking pair of rails and extends circumferentially to overlap same, each overlapping portion defining with the adjacent side of the radially inner portion a recess in said stub which recess is closely opposed to two sides of the adjacent rail, such that each rail lies in and is at least in part bounded by opposed surfaces of the opposed recess of two adjacent retaining stubs;

adjusting screws on each rail having means for abutting the opposed surface of the adjacent stub radially inner portion and adjustable for lateral positioning of the corresponding second mould part element transversely of the axis of the mould cavity;

setting screws on the overlapping portions of each stub and having means for bearing against the opposed outward facing surface of the adjacent frame rail for positioning of the corresponding second mould part element radially of the axis of said mould cavity, the axis of each said setting screw extending in a direction transverse to the axis of the adjusting screw which shares the same frame rail and second mould part element;

spring means coactive between each stub and the circumferentially flanking pair of frame rails for resiliently urging said element substantially inward toward said mould cavity axis.

3. Mould for the horizontal production of a continuous casting of metals comprising a first mould part which is adapted to have an intensive cooling effect on the metal being cast and which has a reduced inflow cross-section for the said metal relative to the casting cavity; a support frame; a second mould part connected downstream of said first mould part and which is formed by several elements carried by the support frame, the elements being movable radially relative to the support frame; moving means cooperative with said support frame and second mould part elements and actuable for moving said second mould part elements apart radially far enough that during the withdrawing movement of the continuous casting that the part of the continuous casting entering and located in the second mould part is freed during its withdrawing movement from the elements of the second mould part; springs which act on the elements of the second mould part, the elements being radially displaceable against the action of the springs and being displaceable towards each other by means of these springs, in which each element of the second mould part has angled portions forming a recess, one surface of said recess being a guide surface, said element having a further surface located normal to said guide surface and upon which a respective one of said springs bears.

4. Mould according to claim 1 in which said frame is a common support frame which extends along and commonly supports the first mould part and the second mould part.

5. Mould according to claim 1 in which the elements of the second mould part are formed with guide surfaces, adjustment devices for abutting a said guide surface of one adjacent element being movable parallel to a said guide surface of another adjacent element.

6. Mould according to claim 5 in which each adjustment device comprises a ball, and a screw located in the support frame for displacing the ball.

7. Mould according to claim 1 including bolts located in the support frame and extending outward through a projecting earlike portion of the associated element, the bolts carrying the said springs.

8. Mould according to claim 1 in which an inflow orifice having a reduced open cross-section relative to the casting cavity is located on the inlet side, the axis of the inflow orifice being displaced downwards in relation to the axis of the mould.

9. Mould according to claim 8 in which the lower boundary surfaces of the inflow orifice and of the first and second mould parts are flush.

10. Mould according to claim 1 in which the inner surface of the first mould part is chromium-plated.

11. Mould according to claim 1 in which the inner surface of the first mould part is overlaid with a material selected from the group consisting of graphite, boron nitride, and silicon nitride.

12. Mould according to claim 8 in which the inflow orifice is rounded off.

13. Mould according to claim 1 in which said moving means consists of one of electrical, pneumatic or hydraulic moving mechanisms.

* * * * *